US007900278B2

(12) United States Patent
Pittman et al.

(10) Patent No.: US 7,900,278 B2
(45) Date of Patent: Mar. 8, 2011

(54) ERGONOMIC DUTY GEAR BELT

(75) Inventors: David Pittman, Temecula, CA (US); Wayne Brian Gregory, Fallbrook, CA (US)

(73) Assignee: Safariland, LLC, Jacksonville, FL (US)

( * ) Notice: Subject to any disclaimer, the term of this patent is extended or adjusted under 35 U.S.C. 154(b) by 241 days.

(21) Appl. No.: 11/868,876

(22) Filed: Oct. 8, 2007

(65) Prior Publication Data

US 2008/0210729 A1 Sep. 4, 2008

Related U.S. Application Data

(60) Provisional application No. 60/828,749, filed on Oct. 9, 2006.

(51) Int. Cl.
*A45F 5/00* (2006.01)

(52) U.S. Cl. ..... 2/310

(58) Field of Classification Search ..... 2/310–312, 2/338, 414, 315, 317, 319, 336
See application file for complete search history.

(56) References Cited

U.S. PATENT DOCUMENTS

| | | | | |
|---|---|---|---|---|
| 5,046,488 | A | 9/1991 | Schiek, Sr. | |
| 5,115,802 | A * | 5/1992 | Dyer | 602/33 |
| 5,464,136 | A | 11/1995 | Eddy | |
| 5,489,260 | A | 2/1996 | Striano | |
| 5,724,707 | A | 3/1998 | Kirk et al. | |
| 5,836,489 | A | 11/1998 | Swetish | |
| 6,041,444 | A * | 3/2000 | McKinney | 2/310 |
| 6,137,675 | A | 10/2000 | Perkins | |
| 6,398,092 | B1 | 6/2002 | Ansley | |
| 6,769,586 | B1 | 8/2004 | Beletsky et al. | |
| D501,288 | S | 2/2005 | Taylor | |
| 6,941,585 | B2 | 9/2005 | Wells, Jr. | |
| 7,081,102 | B1 | 7/2006 | Koetter et al. | |
| 7,454,800 | B2 * | 11/2008 | Taylor et al. | 2/338 |
| 7,575,136 | B2 * | 8/2009 | Kernkamp | 224/159 |
| 2003/0029897 | A1 | 2/2003 | Beletsky et al. | |
| 2004/0144823 | A1 | 7/2004 | Obatake | |
| 2004/0226972 | A1 | 11/2004 | Cook | |

OTHER PUBLICATIONS

International Search Report for International Application No. PCT/US2007/021592; Completion of Search Aug. 25, 2008; Date of Mailing Sep. 2, 2008; 2 pages.

Written Opinion of the International Searching Authority for International Application No. PCT/US2007/021592; Completion of Opinion Aug. 25, 2008; Date of Mailing Sep. 2, 2008; 5 pages.

* cited by examiner

*Primary Examiner* — Tejash Patel
(74) *Attorney, Agent, or Firm* — Kane Kessler, P.C.; Paul E. Szabo

(57) ABSTRACT

An ergonomic duty gear belt for carrying duty gear components having a first curved conically shaped side section and a second curved conically shaped side section pivotably hinged together and a lumbar pad wrapped around the hinged connection of the belt to provide support for the lumbar area of the wearer.

17 Claims, 2 Drawing Sheets

ERGONOMIC DUTY GEAR BELT

CROSS-REFERENCE TO RELATED APPLICATION(S)

This application claims priority to U.S. Provisional Application No. 60/828,749 filed Oct. 9, 2006.

BACKGROUND OF THE INVENTION

The present invention is directed to an ergonomically improved duty gear belt worn by police officers or military personnel which is conically contoured and can be worn around the hips to distribute the load of duty gear components over wider areas of the hips.

Law enforcement, military personnel and the like require an extensive array of accessories to perform their assigned duties. For example, police officers carry a wide range of accessories such as a night stick, a flashlight, a chemical agent dispenser, handcuffs, communications radio, firearms, and extra ammunition magazines for their firearm. The total weight of these accessories can often reach up to 25 pounds. Typically, these accessories are attached to a belt worn around their waist and commonly referred to as a duty gear belt. Typical prior art duty gear belts are formed of a semi-rigid material, such as leather having a constant width of about two to two and one-half inches. Each of the various accessories are attached to the duty gear belt through the use of loops or other fasteners which connect them to the duty gear belt.

Although these duty gear belts were effective in connecting the accessories to the waist of the wearer, they were not designed for ergonomic comfort or to provide desirable weight distribution of the accessories around the waist of the user. Due to the heavy weight of the accessories and the non-ergonomic design of prior duty gear belts, many wearers developed discomfort during use and even as severe as back injuries and nerve damage.

Consequently, there is a need for an ergonomic duty belt that is comfortable, reduces injury and evenly distributes the weight of the duty gear accessories upon the wearer.

SUMMARY OF THE INVENTION

The present invention is an ergonomically improved duty gear belt worn by police officers or military personnel designed so that it is contoured and can be worn around the hips to distribute the load over a wider area of the body. The duty gear belt of the present invention effectively transfers the load of law enforcement or military duty gear and holsters to the hips of the wearer and also can provide ballistic protection to the waistline and lower back of the wearer. The duty gear belt is a padded contoured belt which can be either attached to a police belt or duty gear pouches and holsters, or can be integrally formed to accommodate duty gear components.

The duty gear belt is a conically shaped belt contoured around the hips to distribute load over wide areas of the hips. The belt is a three-piece design having two side portions which are hinged in the back. The hinged connection includes a fastener which extends through the two separate side sections along the top and has a secondary adjustment strap positioned along the bottom of the jointed sections to provide a secondary adjustment to secure the belt to the waist. A strap is also positioned in the front of the belt having connectors to secure the belt around the wearer.

The two sections of the belt can either be padded or can include ballistic packages to provide ballistic protection to the duty gear belt. The two side sections have an interior fabric that is made of a stretchable material to form a curved shape to the side sections. The side sections are molded in a geometrical curved configuration by sewing the stretch material to the outer covering of the side sections to achieve the conical shape. The conical shape alternatively can be formed by a molding process. Positioned on the exterior surface of the duty gear belt are keepers for attaching the duty gear components to the belt. The keepers can be webbing for a Molle system for attaching the duty gear components for tactical applications or other types of fasteners to connect the individual components of the duty gear or holsters.

The duty gear belt of the present invention also includes a lumbar pad connected to each of the side components in the rear which wraps around the hinged connection and provides support and ballistic protection in the lumbar area of the wearer. The present invention improves load distribution, increases comfort and reduces stress on the lower back of the wearer.

DETAILED DESCRIPTION OF THE INVENTION

Figure 1:
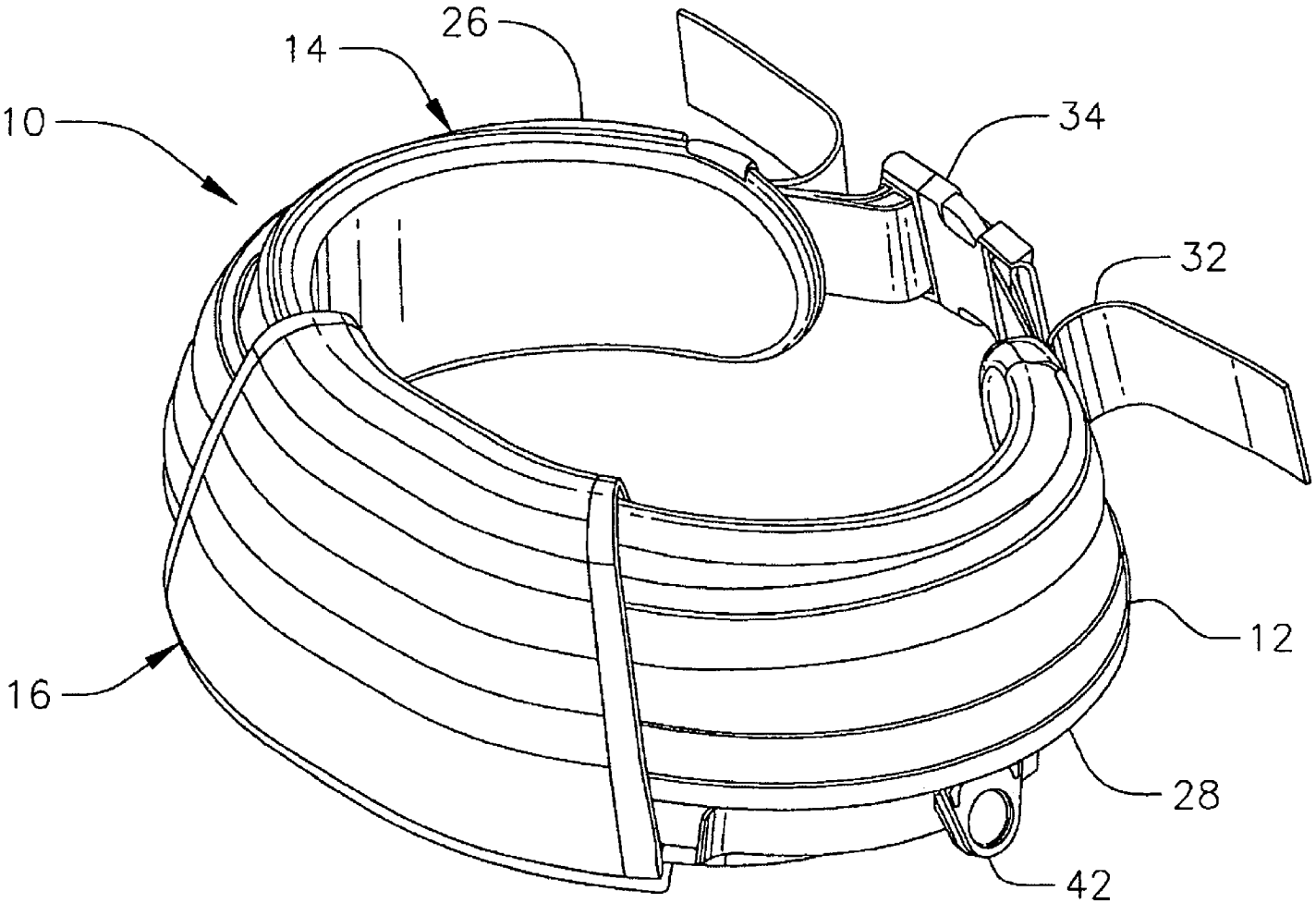
FIG. 1 is a perspective view of the ergonomic duty belt of the present invention.
Figure 2:
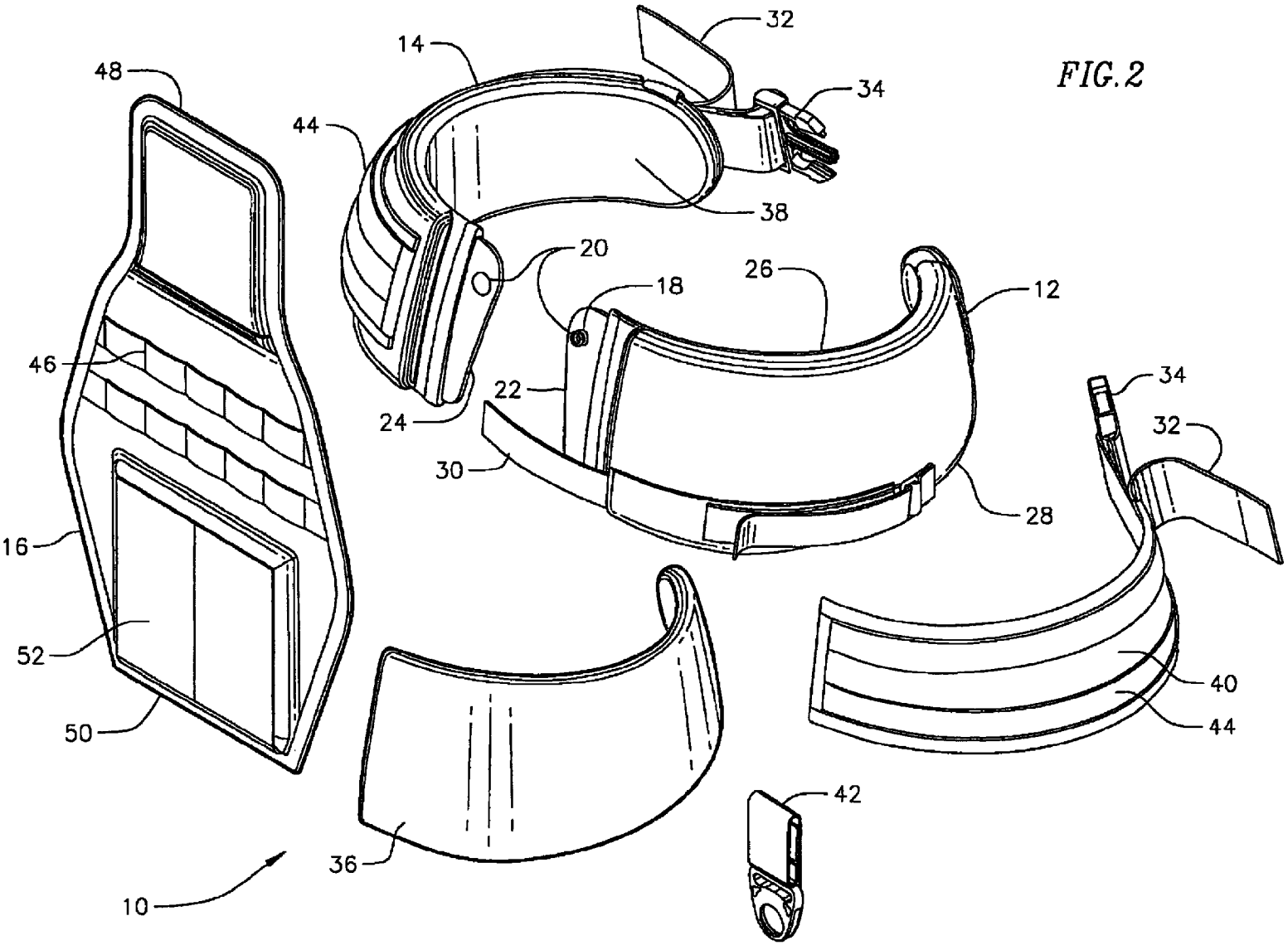
FIG. 2 is an exploded view of FIG. 1.

FIGS. 1 and 2 illustrate the ergonomic duty gear belt 10 of the present invention. The duty gear belt 10 is ergonomically designed to be worn by police officers or military personnel and is contoured to be worn around the hips of the wearer to distribute the load over a wider area of the hips. The duty gear belt 10 is a three-piece design having side portions 12 and 14 and a lumbar pad section 16. Side portions 12 and 14 are hinged in the back. The hinged connection includes a fastener 18 which extends through holes 20 in side sections 22 and 24. The fastener 18 is positioned through holes 20 in an upper portion of side sections 22 and 24 so that the belt can rotate about the fastener to adjust for wider or narrower hip sizes of the wearer. The belt is designed to be conically shaped to have a smaller diameter along the top surface 26 and a larger bottom diameter along lower surface 28. The hinged connection allows for the overall conical shape to be adjusted depending upon the anatomical shape of the user of the belt. A secondary adjustment strap 30 is attached along the lower section of side portion 12 to connect to the lower portion of side portion 14 to adjustably fasten the lower portions of the side sections together. The secondary adjustment strap 30 provides a secondary adjustment to secure the belt to the waist of the wearer. Similarly, there is a front strap 32 having a buckle 34 to secure the belt around the wearer in the front.

The two side sections 12 and 14 have a pad 36 positioned within the interior of the sections. The pad 36 can be simply a foam pad for comfort or can be a ballistic package having a plurality of sheets of ballistic material, commonly known in the industry depending upon the threat level for which the duty gear belt is designed to provide protection. The two side sections have an interior fabric panel 38 that is made of a stretchable material to form a curved shape to the side sections. The side sections are molded into a geometrical configuration by sewing the stretch material to the outer covering 40 to achieve the conical shape. Alternatively, the side sections can be molded into its geometrical configuration by a molding process.

Positioned on the outer covering 40 are keepers 42 for attaching the various duty gear items to the belt. Similarly, webbing 44 can be attached to the outer covering for use with a Molle system of attaching the duty gear components to the belt for tactical applications. Similarly, other types of fasteners such as hooks, buttons, snaps, or Velcro can be positioned on the outer covering for attachment of duty gear components. The webbing 44 as shown in more detail on the back pad 16 includes rows of stitching 46 to provide individual slots for the Molle system.

The lumbar pad 16 has a narrower connection portion 48 which attaches to the hinged connection location of the side sections and a lower portion 50 having a support pad 52 positioned on its surface. The connection portion 48 attaches to the side portions and the pad is wrapped around the belt such that the pad 52 provides support and padding in the lumbar area of the wearer. Webbing 46 is located on an exterior surface for attachment of duty gear components. The duty gear belt of the present invention effectively transfers the load of the duty gear components across a wider area of the hips of the wearer and can provide ballistic protection to the waistline and the lower back of the wearer. The duty gear belt of the present invention improves load distribution, increases comfort and reduces stress on the lower back of the wearer. Typically materials used for the duty gear belt is canvas or nylon in addition to the stretchable material to provide as light of weight belt as possible.

Although the present invention has been described and illustrated with respect to a preferred embodiment thereof, it is to be understood that changes and modifications can be made therein which are within the full intended scope of the invention as hereinafter claimed.

What is claimed is:

1. An ergonomic duty gear belt for supporting duty gear components comprising:

a first side section;

a second side section;

a pivotable hinged connection between the first side section and the second side section located at an upper end portion of each side section and at a lumbar portion of the duty gear belt to create a fixed upper diameter;

a secondary adjustment strap located along a lower portion of either the first or second side section along a distal edge to create an adjustable lower diameter to adjust a gap between the first side section and the second side section along the lower diameter; and a lumbar pad section wrapped around and encircling the lumbar portion of the duty gear belt.

2. The duty gear belt of claim 1 wherein each the first side section and the second side section is padded.

3. The duty gear belt of claim 1 further comprising a ballistic package containing a plurality of layers of ballistic material located within an interior of each of the first side section and the second side section.

4. The duty gear belt of claim 1 wherein the first side section and the second side section have a curved conical shape by having a stretchable material on an inner surface and a smaller upper diameter and a larger lower diameter.

5. The duty gear belt of claim 1 wherein the first side section, the second side section and the lumbar pad section have fasteners on an outer surface for attachment of the duty gear components.

6. The duty gear belt of claim 1 wherein the first side section, second side section and lumbar pad section have webbing sewn on an outer surface for attachment of the duty gear components.

7. The ergonomic duty gear belt of claim 1 further comprising a front strap for securing the first side section and second side section around the waist of the wearer.

8. A duty gear belt comprising a two-piece conically curved belt hinged together along an upper portion to create a fixed upper diameter and an expandable lower diameter of the belt.

9. The duty gear belt of claim 8 further comprising a lumbar pad wrapped around the belt to provide support for a lumbar area of the wearer.

10. The duty gear belt of claim 8 wherein the two-piece conically curved belt is padded.

11. The duty gear belt of claim 8 wherein the duty gear belt includes a ballistic package to provide ballistic protection for a waist area of a wearer.

12. The duty gear belt of claim 8 wherein a stretchable material is positioned on an inner surface of the duty gear belt and the belt has a smaller upper diameter and a larger lower diameter.

13. The duty gear belt of claim 8 wherein the belt has a plurality of fasteners positioned on an outer surface for attachment of duty gear components.

14. The duty gear belt of claim 8 wherein the belt has webbing sewn on an outer surface for attachment of duty gear components.

15. The duty gear belt of claim 8 wherein the belt has a secondary adjustment strap to adjust a lower diameter of the belt.

16. The duty gear belt of claim 8 further including a front strap for securing the belt around the waist of a wearer.

17. A duty gear belt comprising:

a first conically curved side section;

a second conically curved side section; and a lumbar pad wrapped around a portion of each of the first and second side sections, wherein the first and second side sections are curved by having a stretchable fabric positioned on an inner surface of each section between a fixed smaller diameter upper portion and an expandable larger diameter lower portion, wherein the first curved side section and the second curved side section are hingedly connected to one another at the smaller diameter upper portion; and wherein an adjustment strap is adjacent the larger diameter lower portion to adjust a gap between the first side section and the second side section along the larger diameter lower portion.

* * * * *